US006024292A

United States Patent [19]

Wilson

[11] Patent Number: 6,024,292

[45] Date of Patent: Feb. 15, 2000

[54] DECORATIVE STRUCTURE TO HUMIDIFY AND HEAT INTERIOR LIVING SPACE

[76] Inventor: Russell G. Wilson, 184 Roses Grove Rd., Water Mill, N.Y. 11976

[21] Appl. No.: 08/979,352

[22] Filed: Nov. 26, 1997

[51] Int. Cl.[7] ..... F24F 3/14

[52] U.S. Cl. ..... 237/78 R; 96/294

[58] Field of Search ..... 237/78 R; 239/17; 96/294; 165/222

[56] References Cited

U.S. PATENT DOCUMENTS

| | | | |
|---|---|---|---|
| 1,309,519 | 7/1919 | Hagerman | 237/78 R |
| 1,325,559 | 12/1919 | Eckelmann | 237/78 R |
| 1,886,192 | 11/1932 | Jones | 237/78 R |
| 1,905,422 | 4/1933 | Rasmussen | 237/78 R |
| 3,227,064 | 1/1966 | Spangle | 237/78 R |
| 3,917,759 | 11/1975 | Martin | 237/78 R |

*Primary Examiner*—Henry Bennett
*Assistant Examiner*—Derek S. Boles

[57] ABSTRACT

A decorative structure to humidify and heat interior living space including a housing having a water reservoir at the bottom and a weir at the top, a vertically disposed sheet located in the housing between the reservoir and the weir, the sheet having a rear face and an exposed front face, a heat member located in proximity to the rear face of the sheet for heating the sheet and a submersible pump located in the reservoir with lines to pump water from the reservoir to the weir during operation and use to allow the water pumped to the weir to cascade over the exterior face of the sheet and back to the reservoir.

4 Claims, 3 Drawing Sheets

DECORATIVE STRUCTURE TO HUMIDIFY AND HEAT INTERIOR LIVING SPACE

BACKGROUND OF THE INVENTION

1. Field of the Invention

The present invention relates to a decorative structure to humidify and heat interior living space and more particularly pertains to heating and humidifying an interior living space with a decorative radiant hot water heater.

2. Description of the Prior Art

The use of devices to humidify and heat space through devices of various designs and configurations is known in the prior art. More specifically, devices to humidify and heat space through devices of various designs and configurations heretofore devised and utilized for the purpose of heating and humidifying interior spaces are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,290,025 to Engalitcheff discloses a trough system for evaporative heat exchanges. U.S. Pat. No. 4,026,285 to Jackson discloses a humidifier for air to be inhaled. U.S. Pat. No. 4,217,315 to Keler discloses a humidifier. U.S. Pat. No. 4,284,128 to Nelson discloses an air condition and heat dispenser that takes circulated liquid that is cooled by evaporation and subsequently used to air condition occupant spaces without humidity increase. U.S. Pat. No. 4,775,447 to Kock et al. discloses a spray booth apparatus for the separation of liquid and solid particles from a gas and more particularly to an improved spray booth for removing paint overspray from air. U.S. Pat. No. 4,608,064 to Naadow discloses a multi-wash spray booth and method for capturing air borne particles. U.S. Pat. No. 5,24,728 to Ciang discloses a fountain device for providing indoor aesthetic pleasure by producing the effects of a real outdoors fountain.

While these devices fulfill their respective, particular objectives and requirements, the aforementioned patents do not describe a decorative structure to humidify and heat interior living space that allows heating space and/or humidifying space through various methods and apparatuses.

In this respect, the decorative structure to humidify and heat interior living space according to the present invention substantially departs from the conventional concepts and designs of the prior art, and in doing so provides an apparatus primarily developed for the purpose of heating and humidifying an interior living space with a decorative radiant hot water heater.

Therefore, it can be appreciated that there exists a continuing need for a new and improved decorative structure to humidify and heat interior living space which can be used for To heat and humidify an interior living space with a decorative radiant hot water heater. In this regard, the present invention substantially fulfills this need.

SUMMARY OF THE INVENTION

In view of the foregoing disadvantages inherent in the known types of Devices to humidify and heat space through devices of various designs and configurations now present in the prior art, the present invention provides an improved decorative structure to humidify and heat interior living space. As such, the general purpose of the present invention, which will be described subsequently in greater detail, is to provide a new and improved decorative structure to humidify and heat interior living space method which has all the advantages of the prior art and none of the disadvantages.

To attain this, the present invention essentially comprises a new and improved decorative structure to humidify and heat interior living space comprising, in combination a housing in a generally rectilinear configuration having a rectilinear water reservoir at the bottom and a weir at the top, a vertically disposed essentially planar sheet of marble in a rectangular configuration located in the housing between the reservoir and the weir, the sheet having a rear face and an exposed front face, a heat panel in a rectangular configuration of a size essentially to that of the sheet located in proximity to the rear face of the sheet with a plywood substrate between the sheet and the heat panel, the heat panel having heating tubes therethrough couplable to a source of hot water with a pump to circulate the water through the tubes for heating the heating panel, plywood substrate and sheet, an air circulation fan located at a central vertical extent of the housing spaced from the heat panel for the circulation of air thereadjacent, a submersible pump located in the reservoir with lines to pump water from the reservoir to the weir during operation and use to allow the water pumped to the weir to cascade over the exterior face of the sheet and back to the reservoir and a water fill line coupled to the reservoir for providing additional water to the reservoir to replace that lost from the reservoir and housing through evaporation with a float located in the reservoir to detect depletion of water from the reservoir and an associated switch to provide water from the supply to the reservoir and thereby maintain the reservoir at an adequate level for pumping from the reservoir to the weir and across the exterior face of the marble member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved decorative structure to humidify and heat interior living space which has all of the advantages of the prior art Devices to humidify and heat space through devices of various designs and configurations and none of the disadvantages.

It is another object of the present invention to provide a new and improved a decorative structure to humidify and heat interior living space which may be easily and efficiently manufactured and marketed.

It is further object of the present invention to provide a new and improved a decorative structure to humidify and heat interior living space which is of durable and reliable constructions.

An even further object of the present invention is to provide a new and improved a decorative structure to humidify and heat interior living space which is susceptible of a low cost of manufacture with regard to both materials and labor, and which accordingly is then susceptible of low prices of sale to the consuming public, thereby making such a decorative structure to humidify and heat interior living space economically available to the buying public.

Even still another object of the present invention is to provide a decorative structure to humidify and heat interior living space for heating and humidifying an interior living space with a decorative radiant hot water heater.

Lastly, it is an object of the present invention to provide a new and improved structure to humidify and heat space comprising a housing having a water reservoir at the bottom and a weir at the top, a vertically disposed sheet located in the housing between the reservoir and the weir, the sheet having a rear face and an exposed front face, a heat member located in proximity to the rear face of the sheet for heating the sheet; and a submersible pump located in the reservoir with lines to pump water from the reservoir to the weir during operation and use to allow the water pumped to the weir to cascade over the exterior face of the sheet and back to the reservoir.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
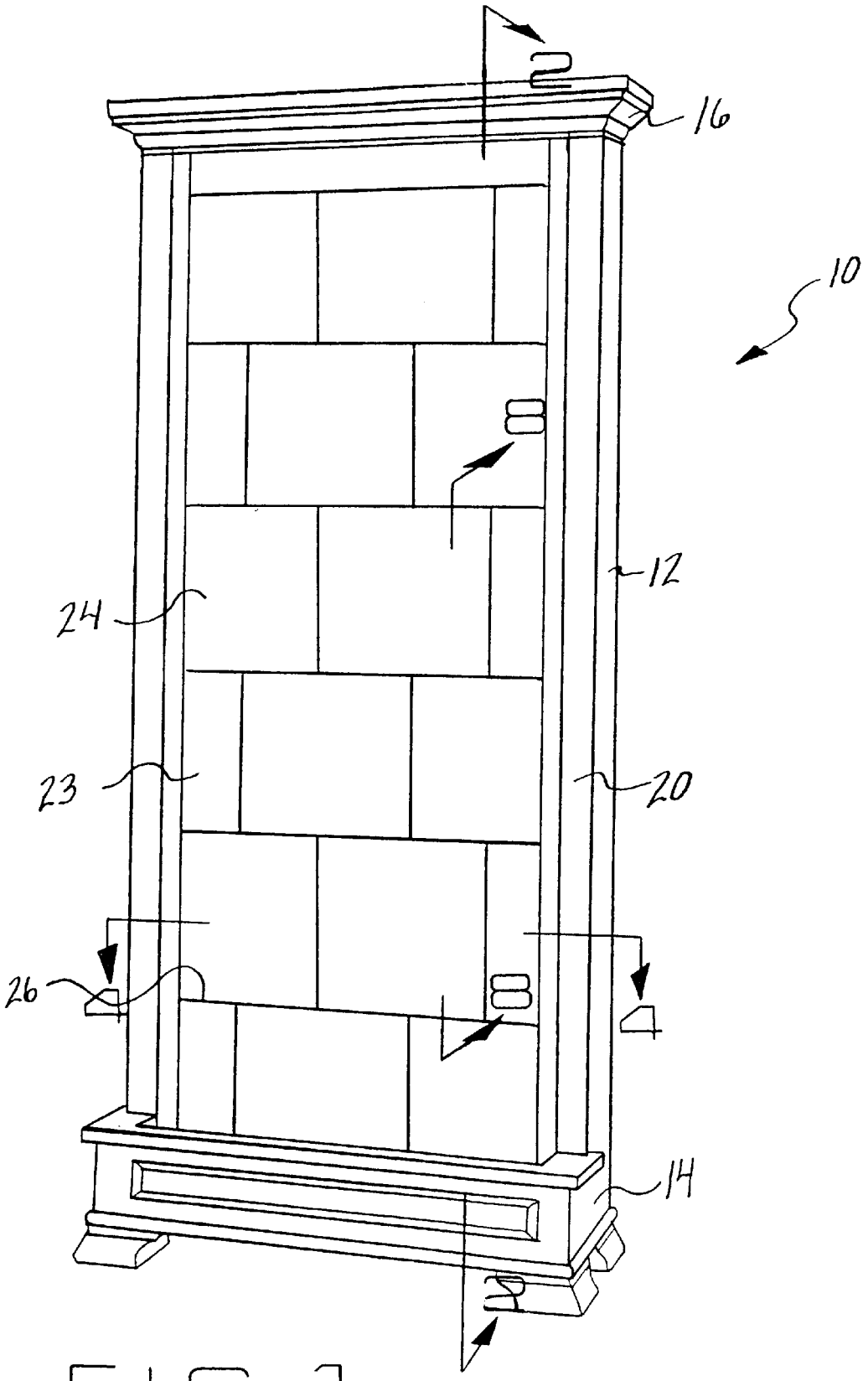
FIG. 1 is a perspective view of the preferred embodiment of the decorative structure to humidify and heat interior living space constructed in accordance with the principles of the present invention.

With reference now to the drawings, and in particular to FIG. 1 thereof, the preferred embodiment of the new and improved decorative structure to humidify and heat interior living space embodying the principles and concepts of the present invention and generally designated by the reference numeral 10 will be described.

The present invention, the decorative structure to humidify and heat interior living space 10 is comprised of a plurality of components. Such components in their broadest context include a housing, a planar sheet, a heat panel, an air circulation fan, a submersible pump and a water fill line. Such components are individually configured and correlated with respect to each other so as to attain the desired objective.

Specifically, the present invention includes a system 10 having as a primary component a housing 12. The housing is configured in a generally rectilinear configuration supported in a vertical orientation. The housing has a rectilinear water reservoir 14 at the bottom and a weir 16 at the top. The reservoir and weir are coupled at the back of the housing through a back plate 18 and side plates 20. Mounted to the weir is a light 22 that contains low voltage lamps.

Figure 3:
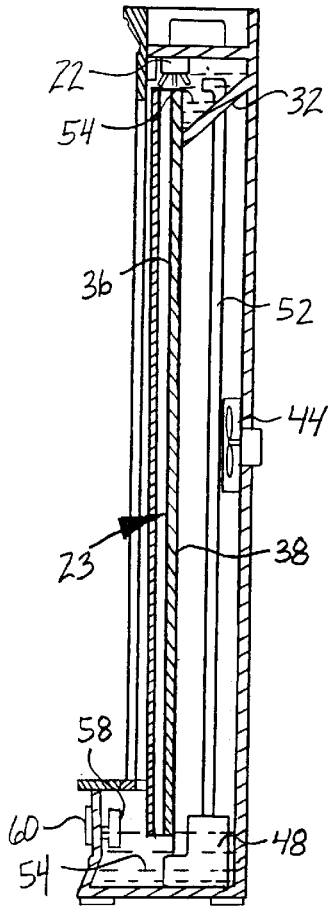
FIG. 3 is a cross-sectional view of the preferred embodiment taken along line 3—3 of FIG. 1.
Figure 4:
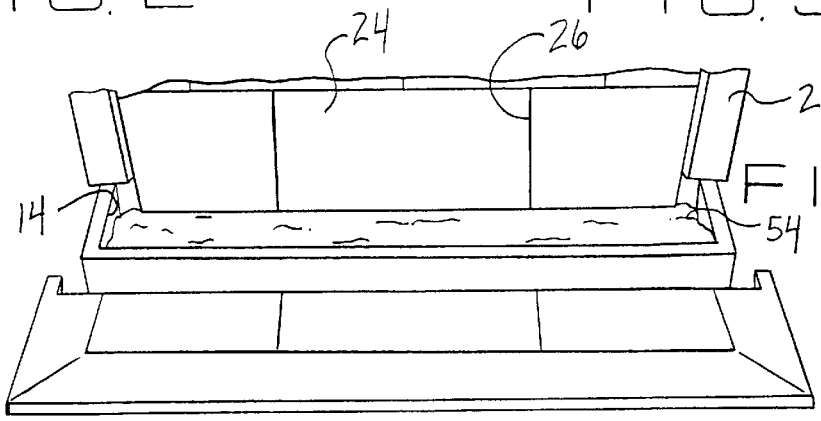
FIG. 4 is a cross-sectional view taken along line 4—4 of FIG. 1.
Figure 7:
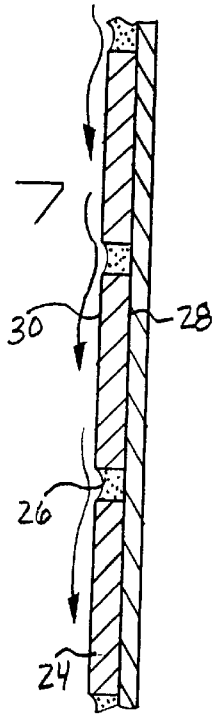
FIG. 7 is a cut-away view of the planar sheet of the preferred embodiment.

Next provided is a vertically disposed, essentially planar sheet 23, as seen in FIG. 1. In the preferred embodiment, such sheet is constructed of marble squares 24 with grouting recesses 26. The overall sheet provides an essentially rectangular configuration. The vertical and horizontal recesses, as depicted in FIG. 7, add turbulence to water flowing over the sheet. The sheet is located in the housing between the reservoir and the weir. The sheet has a rear face 28 and an exposed front face 30. The weir is formed by the upper extent of the sheet and a supplemental plate 32 having a lower end secured to the rear face of the sheet and an upper end above the upper end of the sheet with the side plates of the housing assisting in maintaining water in the weir. FIG. 3 shows the supplemental plate secured to the rear face of the sheet.

Figure 5:
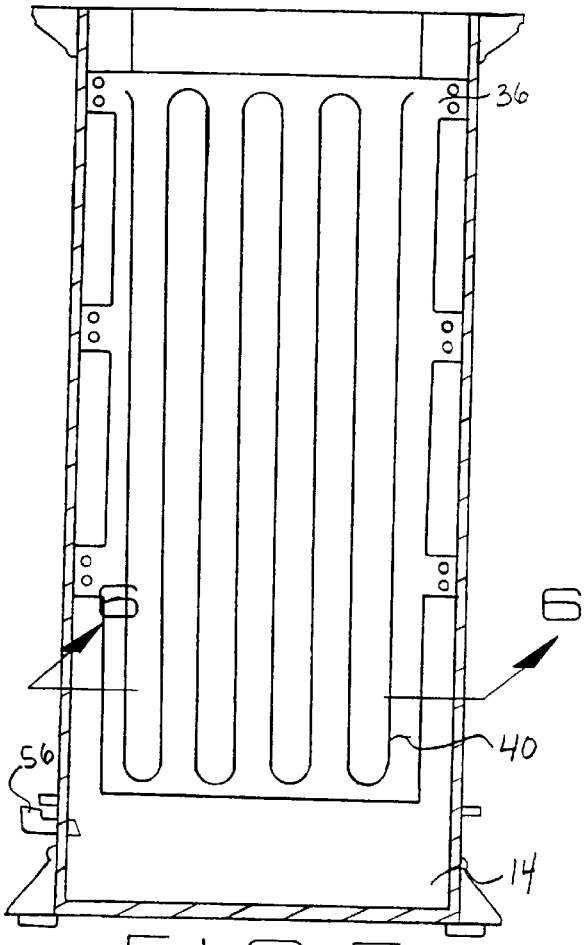
FIG. 5 is a rear view of the preferred embodiment showing the heat panel of the preferred embodiment.
Figure 6:
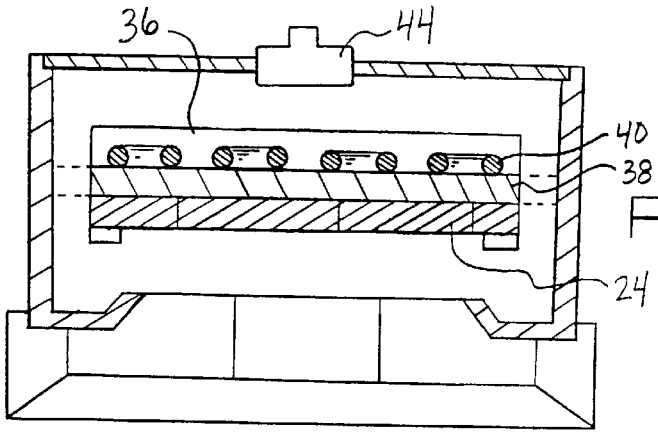
FIG. 6, is a cross sectional view of the preferred embodiment taken along line 6—6 of FIG. 5.
Figure 8:
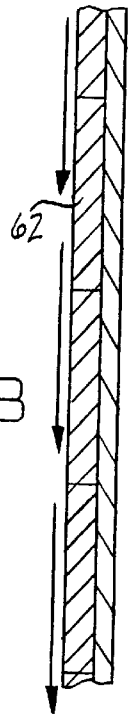
FIG. 8 is a cut-away view of the single sheet of the alternate embodiment.

As best illustrated in FIG. 5, a heat panel 36 is provided. The heat panel, as shown in FIG. 6, is in a rectangular configuration. It is of a size essentially equal to that of the marble sheet described above. It is located in proximity to the rear face of the sheet and includes a plywood substrate 38. The substrate is located between the sheet and the heat panel, as seen in FIGS. 3 and 8. The heat panel has heating tubes 40 winding therethrough in a serpentine fashion. Such tubes are coupled to a source of hot water including a pump to circulate the water through the tubes for heating the heating panel, the plywood substrate, the marble sheet and the water cascading over the sheet.

In association with the housing, is an air circulation fan 44. FIG. 3 shown the fan located in a central vertical opening of the housing rear face 18. The fan is spaced from the heat panel for the circulation of air thereadjacent. This facilitates the evaporation of cascading water.

Also, located in the reservoir is a submersible pump 48. The submersible pump is provided with vertical water lines 52 to pump water 54 to the weir from the reservoir during operation and use. This allows the pumped water in the weir to cascade over the exterior face of the sheet and back to the reservoir while providing heat and humidity to the space in which the system is located.

Lastly provided is a water fill line 56. Such line is coupled to the reservoir 14 and functions for providing additional water to the reservoir. This is to replace water lost from the reservoir and housing through evaporation. In association therewith, there is provided a float 58. The float, as shown in FIG. 3, is located in the reservoir to detect depletion of water from the reservoir. An associated switch 60 functions to provide supplemental water from a supply to the reservoir upon lowering of the float. As a result, an adequate level of water is maintained in the reservoir for pumping from the reservoir to the weir and across the exterior face of the marble sheet.

Figure 2:
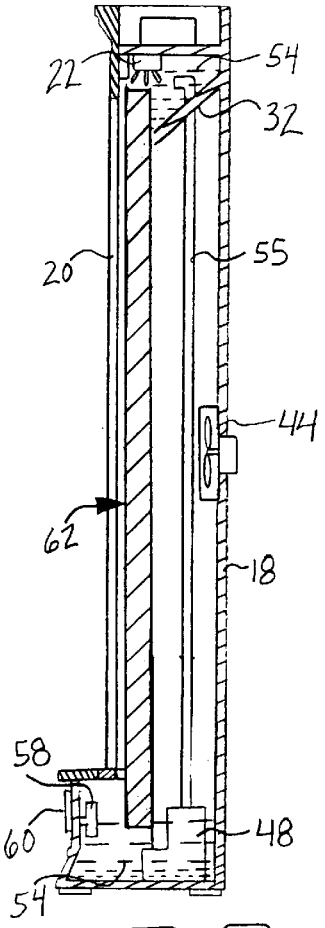
FIG. 2 is a cross-sectional view of the alternate embodiment of FIG. 1 with a single sheet.

In an alternate embodiment of the invention the marble sheet fabricated of plural squares is replaced by a single sheet 62, as shown in FIGS. 8 and 2. Such sheet is of any rigid material, as for example, marble, metal, plastic or the like. The exterior face in any of the embodiments may be decorated with art work such as a picture to enhance the pleasure of a viewer. The pleasure is further enhanced by the heat and humidity provided. Pleasure is additionally provided through the sound of the cascading water.

Lastly, the heating tubes 40 of the primary embodiment are replaced by electrical resistance elements 64 to effect the heating of the cascading water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved decorative structure to humidify and heat interior living space comprising, in combination:

a housing in a generally rectilinear configuration having a rectilinear water reservoir at the bottom and a weir at the top;

a vertically disposed essentially planar sheet of marble in a rectangular configuration located in the housing between the reservoir and the weir, the sheet having a rear face and an exposed front face;

a heat panel in a rectangular configuration of a size essentially to that of the sheet located in proximity to the rear face of the sheet with a plywood substrate between the sheet and the heat panel, the heat panel having heating tubes therethrough couplable to a source of hot water with a pump to circulate the water through the tubes for heating the heating panel, plywood substrate and sheet;

an air circulation fan located at a central vertical extent of the housing spaced from the heat panel for the circulation of air thereadjacent;

a submersible pump located in the reservoir with lines to pump water from the reservoir to the weir during operation and use to allow the water pumped to the weir to cascade over the exterior face of the sheet and back to the reservoir; and a water fill line coupled to the reservoir for providing additional water to the reservoir to replace that lost from the reservoir and housing through evaporation with a float located in the reservoir to detect depletion of water from the reservoir and an associated switch to provide water from the supply to the reservoir and thereby maintain the reservoir at an adequate level for pumping from the reservoir to the weir and across the exterior face of the marble member.

2. A structure to humidify and heat space comprising:

a housing having a water reservoir at the bottom and a weir at the top;

a vertically disposed sheet located in the housing between the reservoir and the weir, the sheet having a rear face and an exposed front face;

a heat member located in proximity to the rear face of the sheet for heating the sheet; and a submersible pump located submerged within the reservoir with lines to pump water from the reservoir to the weir during operation and use to allow the water pumped to the weir to cascade over the exterior face of the sheet and back to the reservoir.

3. The device as set forth in claim 1 and further comprising an air circulation fan located at a central vertical extent of the housing spaced from the heat panel for the circulation of air thereadjacent.

4. The device as set forth in claim 1 and further comprising a water fill line coupled to the reservoir for providing additional water to the reservoir to replace that lost from the reservoir and housing through evaporation with a float located in the reservoir to detect depletion of water from the reservoir and an associated switch to provide water from the supply to the reservoir and thereby maintain the reservoir at an adequate level for pumping from the reservoir to the weir and across the exterior face of the marble member.

* * * * *